US005924797A

United States Patent [19]

Netto

[11] Patent Number: 5,924,797

[45] Date of Patent: Jul. 20, 1999

[54] MANUALLY TEARABLE CLOSURE SEAL DEVICE FOR ENVELOPES

[75] Inventor: Eduardo de Lima Castro Netto, Rio de Janeiro, Brazil

[73] Assignee: ELC Produtos de Seguranca Industria E Comercio LTDA, Rio de Janeiro, Brazil

[21] Appl. No.: 08/875,036

[22] PCT Filed: Jan. 25, 1996

[86] PCT No.: PCT/BR96/00004

§ 371 Date: Jul. 17, 1997

§ 102(e) Date: Jul. 17, 1997

[87] PCT Pub. No.: WO96/22922

PCT Pub. Date: Aug. 1, 1996

[30] Foreign Application Priority Data

Jan. 27, 1995 [BR] Brazil ..... 9500348

[51] Int. Cl.[6] ..... B65D 33/16

[52] U.S. Cl. ..... 383/92; 24/30.5 R; 383/5; 383/79; 383/200

[58] Field of Search ..... 24/30.5 R; 215/250, 215/253; 383/92, 79, 5, 200, 207

[56] References Cited

U.S. PATENT DOCUMENTS

| | | | |
|---|---|---|---|
| 1,542,561 | 6/1925 | Laskin et al. | 383/92 X |
| 2,843,309 | 7/1958 | Wheeler | 383/79 X |
| 3,727,829 | 4/1973 | Huni | 383/95 X |
| 4,042,267 | 8/1977 | Clinch et al. | 292/318 |
| 4,983,047 | 1/1991 | Netto | 383/92 X |
| 5,600,978 | 2/1997 | Netto | 383/92 X |

FOREIGN PATENT DOCUMENTS

| | | |
|---|---|---|
| 0 148 159 | 7/1985 | European Pat. Off. . |
| 0 323 706 | 7/1989 | European Pat. Off. . |
| 94 14 734 U | 11/1994 | Germany . |
| WO 93/19992 | 10/1993 | WIPO . |

*Primary Examiner*—Jes F. Pascua
*Assistant Examiner*—Robin A. Hylton
*Attorney, Agent, or Firm*—Smith, Gambrell & Russell, LLP; Beveridge, DeGrandi, Weilacher & Young Intellectual Property Group

[57] ABSTRACT

A device for the closure and sealing of envelopes and the like. First and second elongated strips of plastic material are foldable upon each other along a narrow longitudinal hinge line. The first strip has a series of locking pins distributed along its length. Each of the locking pins has a weakened base. The second strip is provided with a series of sockets adapted for receiving respective locking pins in locking relation therein. To permit the device to be opened easily when it has been applied to a plastic envelope with the locking pins penetrating orifices formed along the two borders at the mouth of the envelope, at least a part along the length of the longitudinal hinge line is weakened starting from a first end, and each strip is provided, at its first end, with an appendage capable of being held between the fingers of the user.

12 Claims, 4 Drawing Sheets

MANUALLY TEARABLE CLOSURE SEAL DEVICE FOR ENVELOPES

TECHNICAL FIELD

The present invention relates to a device for closing and sealing envelopes and the like, especially plastic envelopes for the transport of confidential documents or for rapid delivery services such as courier and related services.

BACKGROUND ART

Devices suitable for this use are well known, one example being that disclosed in Brazilian Patent PI 8903982-3 which describes and illustrates an elongated rectangular piece of plastic in the form of two parallel strips connected to each other along a narrow hinge line around which the strips can be folded over each other. One of the strips is formed along its length with a series of small upstanding locking pins, while the other strip is formed with a corresponding series of sockets for receiving the locking pins in locking relation. The strip with the locking pins is fixed, by means of plastic soldering, along the external border of one side of the mouth of a plastic envelope, with the locking pins perforating both borders of the envelope. To close and seal the envelope one simply has to fold the strip with the sockets around the hinge line and press the two strips together until the locking pins enter the sockets and become held. The envelope is then closed with the hinge line situated along the mouth of the envelope, preventing access thereto.

When the envelope is closed and sealed in this way it is no longer possible to open it without breaking the locking pins which, for preference, have weakened bases. Any unauthorized attempt to open the envelope results in the breakage of one or more locking pins, leaving a clear indication of violation or attempted violation. Normal, or authorised, opening of the envelope is carried out, not at the mouth end because it is difficult, but by cutting open the end opposite to the mouth with scissors, thus leaving the closure device intact for gained by unauthorised persons.

A similar device is described in EP-A-0 323 706 which is an earlier version of the product disclosed in Brazilian patent PI 8903982-3. In that particular case, the hinge line is formed by a series of longitudinally separated transverses bridges between the strips.

OBJECT OF THE INVENTION

The principal object of the present invention is to provide a device, of the type described above, which permits intentional opening of the envelope, via its mouth end, without the need to use scissors to cut it open, while at the same time allowing very simple and quick visual verification of whether or not the seal has been violated.

SUMMARY OF THE INVENTION

According to the present invention a closure and seal device, for closing and sealing envelopes and the like, comprises first and second elongated strips of plastics material, foldable, one over the other, around a narrow longitudinal hinge line extending from a first end to a second end of the device, the first strip being formed with a series of locking pins distributed therealong, each locking pin having a weakened base, and the second strip being formed with a series of sockets adapted for receiving the locking pins in locking relation therein, in a closed and sealed configuration of the device. The device is characterised in that, starting from said first end and along an initial minor extension of the hinge line, the latter is weakened with respect to the remaining major extension thereof so as to define an initial tear line, and that each of the first and second strips is provided with an appendage capable of being held between the fingers of the user whereby, in said closed and sealed configuration, when the user grips and pulls apart said appendages, the strips are torn apart along the tear line, breaking the the weakened bases of the locking pins.

The device according to the present invention can be applied to an envelope in a manner identical to that described in the background art. However, it can be opened by holding each of the appendages and pulling them firmly away from each other, thereby initiating the tearing apart of the two strips, breakage of the locking pins at their weakened bases and the consequent opening of the envelope. In order to check whether or not the device has been violated it is simply necessary to inspect the base of each locking pin to see whether it has been broken cleanly or if someone put adhesive on it in order to hide an unauthorised opening of the envelope. This method of verification is facilitated when the bases of the locking pins are joined to the respective strip of the device by means of small radial bridges in orifices formed in the strip. In this case, inspection can be carried out by holding the strip up to the light in order to check that the orifices are empty with the bridges broken.

The appendage to be held between the fingers of the user may consist of a thin extension, starting from a point at the first end of the respective strip, adjacent to the hinge line. Preferably it is "L" shaped, the "L" being in the plane of its associated strip.

According to a second aspect of the present invention, a plastic envelope supplied with a closure and seal device, the envelope being provided with an opening having first and second superimposed edges and the closure and seal device being that described above, the first strip of the device being fixed externally to the first border of the opening with each locking pin penetrating aligned orifices formed in the first and second edges of the opening, the first and second strips having lengths substantially equal to the lengths of each edge along the mouth of the envelope.

BRIEF DESCRIPTION OF THE DRAWINGS

A preferred embodiment of the present invention will now be described in greater detail, merely by way of example, reference being made to the accompanying drawings in which.

DETAILED DESCRIPTION OF THE INVENTION

Figure 1:
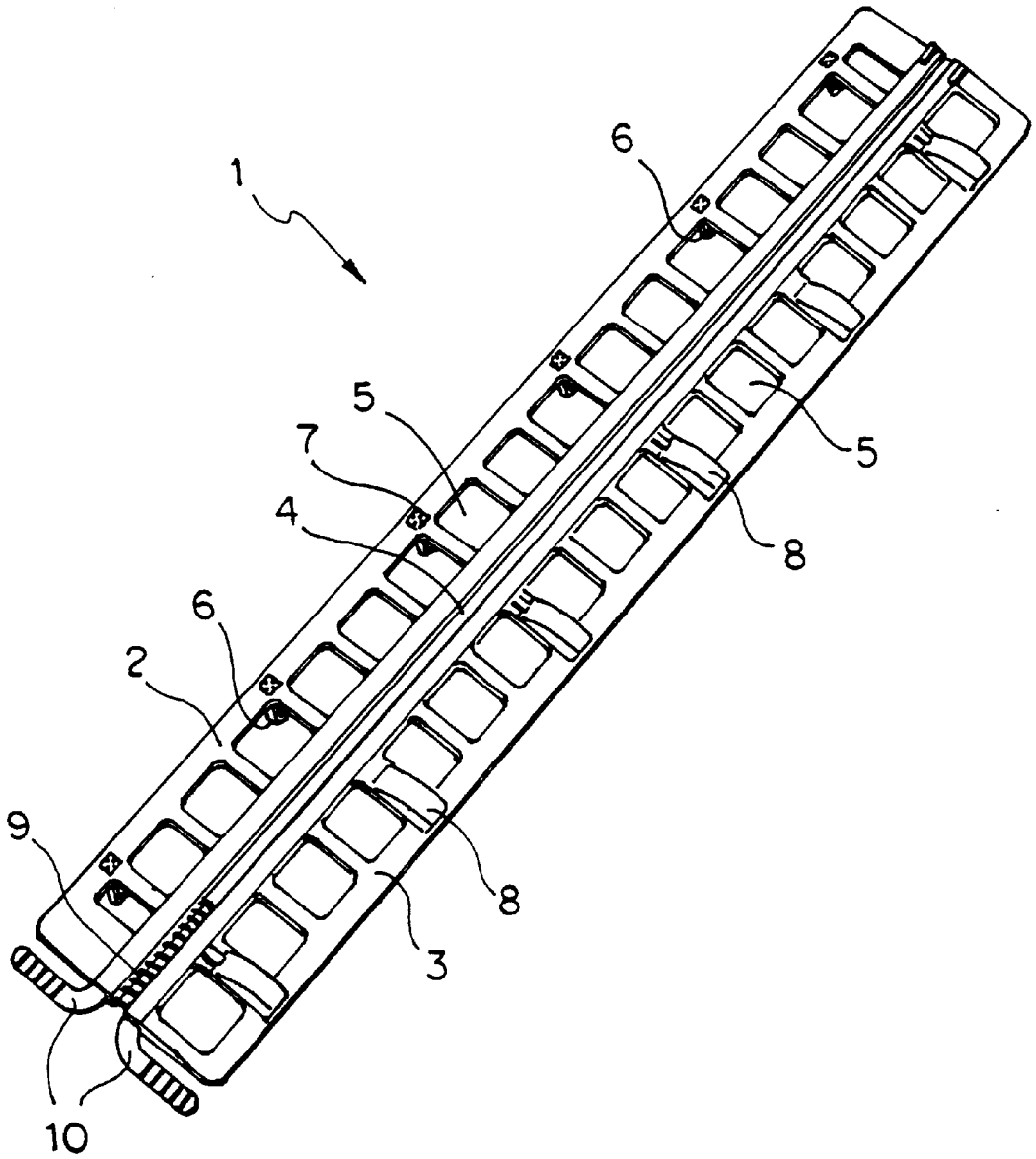
FIG. 1 is a perspective view of a closure and seal device for envelopes, according to a preferred embodiment of the present invention.

The closure and seal device illustrated in FIG. 1 consists of a single piece 1 of molded polypropylene or similar material. It comprises two elongated rectangular strips 2 and 3, connected to each other along a narrow hinge line 4 around which the strips can be folded, one upon the other.

Strips 2 and 3 are provided with rectangular apertures 5 along their lengths, for the purpose of economizing on the material used in their construction.

Strip 2 is formed with a series of locking pins 6 distributed therealong. The base of each locking pin 6 is connected, adjacent to the edge of strip 2 furthest from hinge line 4, to the inner border of a corresponding orifice by means of four small bridges 7, thereby weakening the connection between the locking pin and the strip.

Strip 3 is formed with a corresponding series of sockets 8 distributed therealong, inside each one of which there is a locking formation cooperable with a corresponding locking pin 6. Thus, substantially as described and illustrated in the above mentioned Brazilian patent application PI 8903982-3, upon folding strips 2 and 3 around hinge line 4 and squeezing the outer sides of the strips together, locking pins 6 enter sockets 8 where they become held in locked relation.

In accordance with the present invention, a short length of hinge line 4, starting from one end, is weakened by means of a plurality of perforations 9. Along with this, the internal edge, i.e. the edge adjacent to hinge line 4, of each of strips 2 and 3 is formed at its end with a small "L" shaped appendage 10, in the plane of each respective strip, so that, by holding each appendage 10 between the fingers of each hand and pulling the appendages away from each other, piece 1 is easily torn down its middle along hinge line 4.

Figure 2:
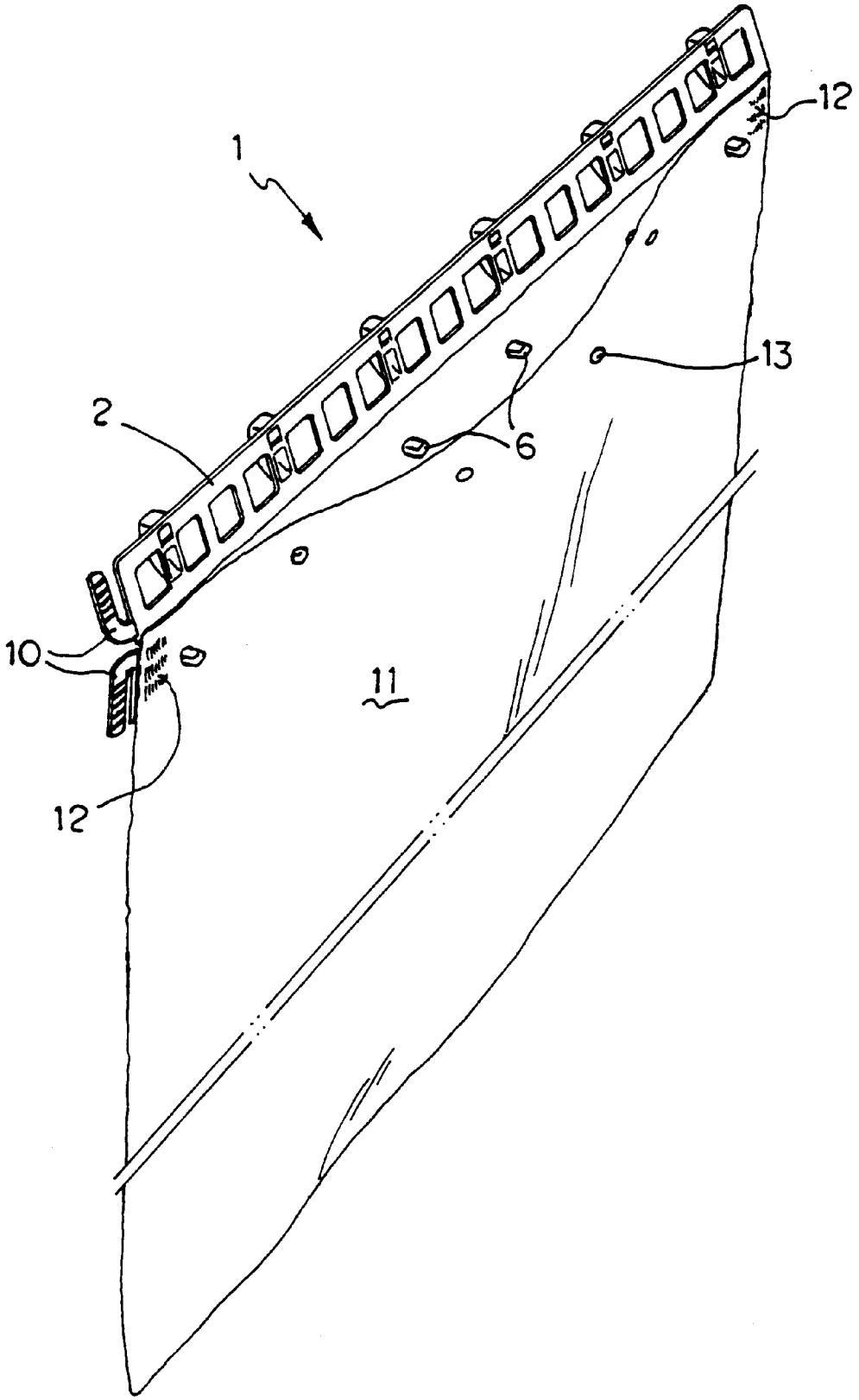
FIG. 2 is a perspective view of the device shown in FIG. 1 mounted on a plastic envelope in preparation for closing.
Figure 3:
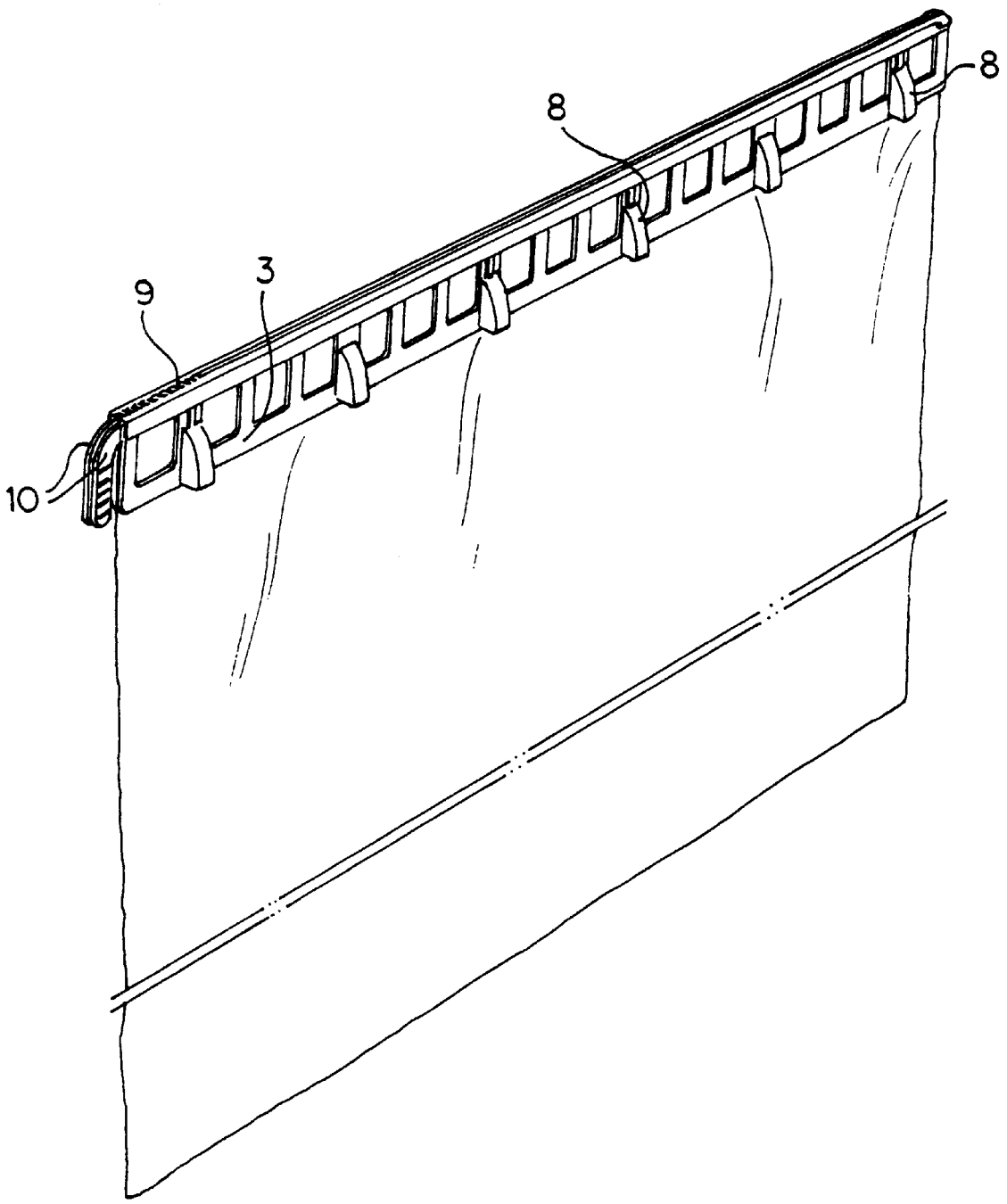
FIG. 3 is a perspective view, similar to that of FIG. 2, but with the envelope closed and sealed by the device according to the invention.

FIG. 2 shows the device of FIG. 1 mounted at the mouth of a plastic envelope 11. Here, strip 2 is placed externally of and along a first border of the mouth of envelope 11 with its transverse ends soldered thereto 12. Locking pins 6 on strip 2 penetrate orifices 13, in the first border, which are in registration with corresponding orifices 13 in a second border on the other side of envelope 11. The envelope is illustrated in its closed configuration in FIG. 3 wherein, starting from the configuration shown in FIG. 2, the front facing, second, border of the mouth of envelope 11 is placed against the first border so that locking pins 6 on strip 2 penetrate orifices 13, whereupon strip 3 is folded downwards until locking pins 6 enter, and become locked in, respective sockets 8.

Figure 4:
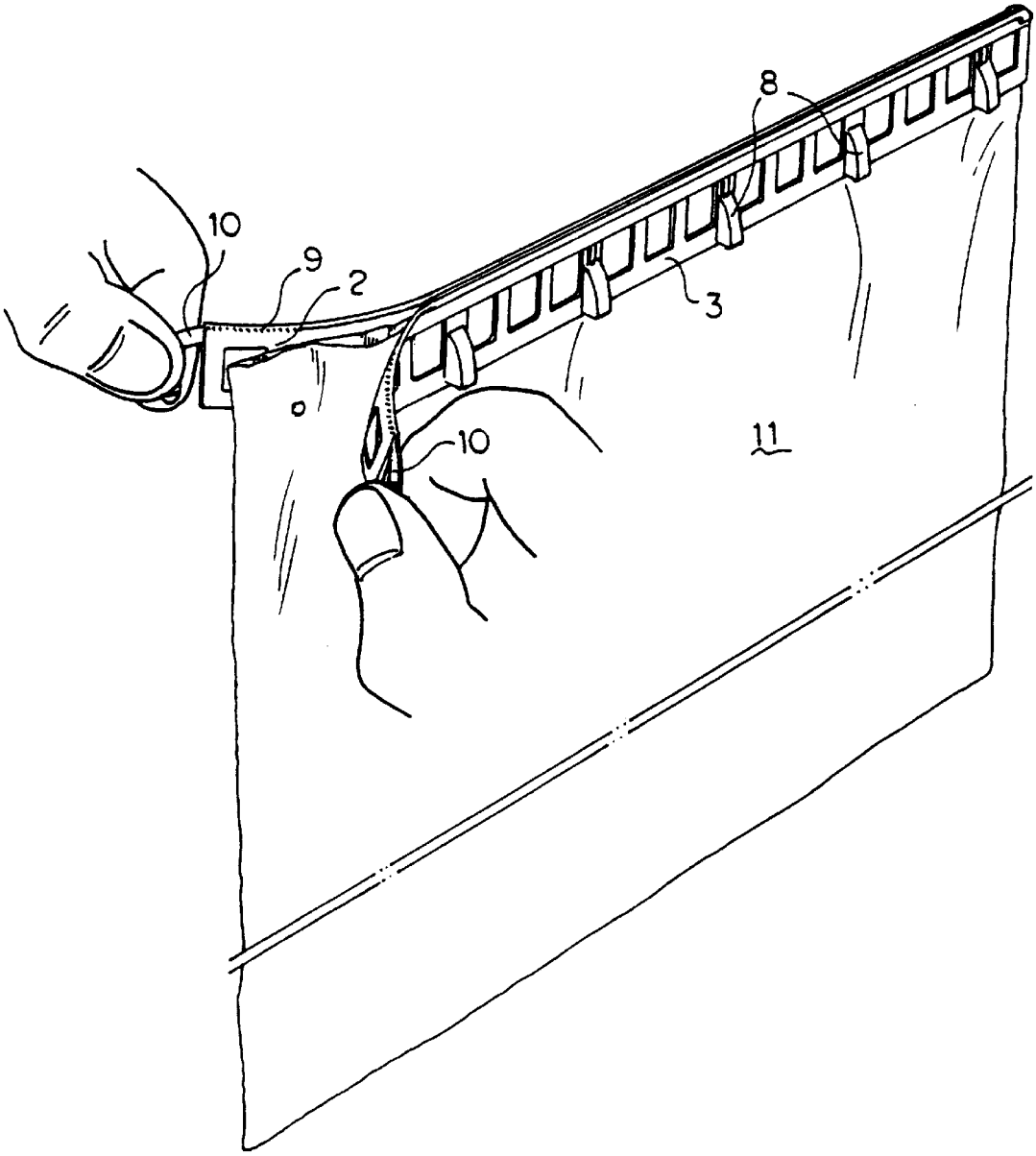
FIG. 4 shows the envelope being opened with the strips of the closure and seal device being pulled apart by the appendages provided by the invention.

Intentional or authorised opening of the envelope is illustrated in FIG. 4, which shows a user gripping appendages 10 between his fingers and pulling them apart. This breaks the length along hinge line 4 weakened by perforations 9 and initiates the tearing of the closure and seal device along the entire length of hinge line 4, such that the small bridges 7, weakening locking pins 6, are broken leaving the pins themselves trapped in sockets 8. Once the envelope has been opened, visual inspection of strip 2—by, for example, holding it up to the light—will show that all the orifices, in which locking pins 6 were held by bridges 7, are empty, that is that there was no attempt to violate the seal, with consequent prior breakage of one or more of the locking pins, camouflaged by the use of adhesive to clog the orifices.

It should be understood that the existence of a hinge line 4 weakened by perforations 9 and the provision of appendages 10 allows greater facility in the opening of envelope 11, without having to use scissors or the like to cut it open and without prejudicing the degree of security afforded by the sealing system.

The device 1 illustrated in the figures is the preferred embodiment of this invention. However, other configurations are possible within the same inventive concept, and it should be understood that changes to the specific sealing system can be made, without going beyond the intended scope of this invention. Similarly, the shape of the appendages 10 can. be modified, the "L" shape being only a preferred configuration, and the length along hinge line 4, weakened due to perforations 9, can be varied as long as it is sufficient to begin the tear as illustrated in FIG. 4.

The scope of the invention should therefore be limited only by the terms and interpretation of the following claims.

I claim:

1. A closure and seal device, for closing and sealing envelopes, comprising first and second elongated strips of plastics material which are foldable, one over the other, around a longitudinal hinge line extending from a first end to a second end of said device, said first strip being formed with a series of locking pins distributed therealong, each of said locking pins having a weakened base, said second strip being formed with a series of sockets, said locking pins being receivable in said sockets in locking relation therein in a closed and sealed configuration of the device, said hinge line being a tear line which includes an initial tear line portion which starts from said first end and extends along an initial minor extension (9) of said hinge line, said initial tear line being weaker than a remaining major extension of said hinge line, each of said first and second strips (3, 2) being provided adjacent said first end of said device with an appendage (10) which is grippable between the fingers of the user whereby, in said closed and sealed configuration, when the user grips and pulls apart said appendages (10), said strips (3, 2) are torn apart along said initial tear line and said hinge line, and said weakened bases (7) of the locking pins (6) are broken.

2. A device according to claim 1, wherein each said appendage (10) includes a thin extension, adjacent to said hinge line (4), starting at said first end.

3. A device according to claim 2, wherein said thin extension (10) is "L" shaped and lies in the same plane as the associated strip (3, 2).

4. A device according to claim 1, wherein said weakened base of each of said locking pins includes small radial connections (7) formed in an aperture in said first strip (3).

5. A device according to claim 2, wherein said weakened base of each of said locking pins includes small radial connections (7) formed in an aperture in said first strip (3).

6. A device according to claims 3 wherein said weakened base of each of said locking pins includes small radial connections (7) formed in an aperture in said first strip (3).

7. A plastic envelope provided with a closure and seal device, said envelope being formed with an opening having first and second superimposed edges, said closure and seal device comprising first and second elongated strips of plastics material of substantially the same length as said edges, said first strip being formed with a series of locking pins distributed therealong, each of said locking pins having a weakened base, and said first strip being fastened externally to said first edge of said opening with each of said locking pins penetrating orifices in said first and second edges of said opening in the envelope, and said second strip being joined to said first strip along a longitudinal hinge line extending from a first end to a second end of said device, around which said second strip is foldable to be superimposed on said first strip with said edges of said envelope held therebetween, said second strip being formed along its length with a series of sockets, said locking pins being receivable in said sockets in locking relation therein in a closed and sealed configuration of the envelope and device, said hinge line being a tear line which includes an initial tear line portion which starts from said first end and extends along an initial minor extension (9) of said hinge line (4), said initial tear line portion being weaker than a remaining major extension of said hinge line, each of said first and second strips (3, 2) being provided with an appendage (10) which is held between the fingers of the user whereby, in said closed and sealed configuration, when the user grips and pulls apart said appendages (10), said strips are torn apart along said initial tear line portion and said hinge line, said weakened bases (7) of the locking pins (6) are broken, and the edges of the opening of the envelope (11) are separated.

8. An envelope according to claim 7, wherein each said appendage includes a thin extension (10), adjacent to said hinge line, starting at said first end.

9. An envelope according to claim 8 wherein said thin extension (10) is "L" shaped and lies in the same plane as the associated strip (3, 2).

10. An envelope according to claim 8, wherein said weakened base of each of said locking pins includes small radial connections (7) formed in an aperture in said first strip (3).

11. An envelope according to claim 8, wherein said weakened base of each of said locking pins includes small radial connections (7) formed in an aperture in said first strip (3).

12. An envelope according to claim 9, wherein said weakened base of each of said locking pins includes small radial connections (7) formed in an aperture in said first strip (3).

* * * * *